US005250872A

United States Patent [19]

Wakimizu et al.

[11] Patent Number: 5,250,872

[45] Date of Patent: Oct. 5, 1993

[54] DISCHARGE LAMP UNIT HAVING IMPROVED DISCHARGE TUBE MOUNT

[75] Inventors: Yukio Wakimizu; Hirohiko Ohshio; Yonemasa Yoshida; Yasuo Hirozumi; Masami Handa, all of Shizuoka, Japan

[73] Assignee: Koito Manufacturing Co., Ltd., Tokyo, Japan

[21] Appl. No.: 730,716

[22] Filed: Jul. 16, 1991

[30] Foreign Application Priority Data

Jul. 20, 1990 [JP] Japan ..... 2-190771
Jan. 17, 1991 [JP] Japan ..... 3-3933

[51] Int. Cl.[5] ..... H01J 61/00; H01J 5/54; H01J 61/34

[52] U.S. Cl. ..... 313/25; 313/318; 313/623; 313/626; 313/634; 313/331

[58] Field of Search ..... 313/25, 318, 623, 624, 313/625, 626, 634, 331

[56] References Cited

U.S. PATENT DOCUMENTS 2,103,028 12/1937 Bol ..... 313/26
5,059,855 10/1991 Irisawa et al. ..... 313/318
5,075,586 12/1991 Jaeger et al. ..... 313/634 X
5,075,587 12/1991 Pabst et al. ..... 313/634 X

FOREIGN PATENT DOCUMENTS 1489417 4/1964 European Pat. Off. .
2747258 10/1977 European Pat. Off. .
0157357 10/1985 European Pat. Off. .
0376260 7/1990 European Pat. Off. .
245080 12/1985 Fed. Rep. of Germany .
2267635 4/1974 France .
2369682 11/1977 France .
2661275 10/1991 France .
2665023 1/1992 France .
1500355 2/1978 United Kingdom .
1544385 5/1979 United Kingdom .

*Primary Examiner*—Donald J. Yusko
*Assistant Examiner*—Ashok Patel
*Attorney, Agent, or Firm*—Sughrue, Mion, Zinn Macpeak & Seas

[57] ABSTRACT

In a discharge lamp unit in which a discharge lamp (10), which is formed by pinch-sealing (13*a*, 13*b*) a glass tube in such a manner as to define a closed glass ball (12) forming an electric discharge region substantially at the middle of the ball and in which discharge electrodes (15*a*, 15*b*) are arranged confronted with each other, is supported at both ends by metal supports (30, 40) which are welded to a short lead support (22) and a long lead support (24) protruding from an insulating base (20) in such a manner that the lead supports (22, 24) are parallel to one another with a predetermined distance therebetween and are parallel to the discharge axis of the lamp. The metal support (30) which supports the rear end portion of the discharge lamp has a discharge lamp holding portion (34) which is arcuate, and the part (14) of the rear end portion of the discharge lamp which is held by the discharge lamp holding portion of the metal support is circular in cross section. Thus, the metal supports which support the discharge lamp can be manufactured readily, and the discharge lamp is high in durability and can be easily adjusted in position.

7 Claims, 5 Drawing Sheets

DISCHARGE LAMP UNIT HAVING IMPROVED DISCHARGE TUBE MOUNT

BACKGROUND OF THE INVENTION

This invention relates to discharge lamp units, and more particularly to a discharge lamp unit which has discharge electrodes confronted with each other in a closed glass tube.

A conventional discharge lamp unit of this type is constructed as shown in FIG. 1. A pair of lead supports 3 and 4 serving as conductors are embedded in an insulating base 2, which is a lamp holder of molded of a synthetic resin. The lead supports 3 and 4 support a discharge lamp 5. In the discharge lamp 5, a pair of electrodes 6 are held confronted with each other in a closed glass tube 5*a*. The closed glass tube 5*a* has pinch-sealed portions 5*b* at both ends, in which molybdenum foils 7 are sealed. The molybdenum foils 7 are connected to respective lead wires 8, which extend from the pinch-sealed portions 5*b*. Metal supports 9*a* and 9*b* are welded to the lead supports 3 and 4. At the rear end of the discharge lamp, the lead wire 8 is welded to the metal support 9*a*, and at the front end, the pinch-sealed portion 5*b* of the discharge lamp is held with the metal support 9*b*.

In the above-described conventional discharge lamp unit, the pinch-sealed portion 5*b* of the discharge lamp 5 because held by the metal support 9*b* is rectangular in cross section, as shown in FIG. 5, stress tends to concentrate at the corners thereof. In addition, stress applied to the pinch-sealed portion 5*b* during the pinch-sealing operation remains as initial stress (residual stress), so that the internal stress created in the pinch-sealed portion 5*b* when the latter is held by the metal support 9*b* is accordingly increased, as a result of which the pinch-sealed portion is liable crack at the corners. That is, the pinch-sealed portion suffers from a difficulty that it is low in durability.

The metal support 9*b* is bent in conformance with the configuration of the rectangular-section pinch-sealed portion 5*b*, which is considerably small. It is rather difficult to form the metal support 9*b* by bending a metal plate in this manner. Hence, the metal support 9*b* so formed is liable to be erroneous in its dimensions; that is, sometimes the holding portion of the metal support 9*b* is too loose or too tight.

Since the metal support 9*b* and the pinch-sealed portion 5*b* are both rectangular in section, they cannot be turned relative to each other, and it is accordingly difficult to adjust the position of the discharge region of the discharge lamp with respect to the reflector.

SUMMARY OF THE INVENTION

In view of the above-described difficulties accompanying a conventional discharge lamp unit, an object of the invention is to provide a discharge lamp unit in which the metal support can be formed with ease, and the discharge lamp is high in durability and can be readily adjusted in position.

The foregoing and other objects of the invention have been achieved by the provision of a discharge lamp unit in which a discharge lamp comprising a closed glass ball, which includes pinch-sealed portions extending from both ends of the closed glass ball formed by pinch-sealing a cylindrical glass tube near both ends, discharge electrodes arranged confronting each other in the closed glass ball, and lead wires protruding from respective ones of the pinch-sealed portions, is connected to an insulating base with the pinch-sealed portions supported by metal supports which are secured to a pair of lead wires which are different in length from each other and protrude from the insulating base, in which, according to the invention, the pinch-sealed portion has an elongation at the end thereof which is a part of an original cylindrical glass sleeve or pipe which is not pinch-sealed, and the elongation is held with a band-shaped metal support.

The elongation of the discharge lamp which is held with the metal support is a part of the original cylindrical glass tube which is free from residual stress because it is not pinch-sealed. In addition, because the elongation is in the form of a cylinder circular in cross section, it contains little stress compared with an elongation which is in the form of a pipe rectangular in cross section. The internal stress due to the holding of the elongation with the metal support is small.

The lamp holding portion of the metal support is formed so as to coincide in configuration with the outer cylindrical wall of the elongation of the discharge lamp. Hence, the lamp holding portion can be formed with ease compared with a lamp holding portion rectangular in section.

Since the lamp holding portion of the metal support and the elongation of the discharge lamp are circular in cross section, the discharge lamp can be turned with respect to the metal support, and therefore the position of the discharge lamp can be readily adjusted with respect to the reflector.

The foregoing and other objects of the invention have further been achieved by the provision of a discharge lamp unit, in which a discharge lamp which is formed by pinch-sealing a glass tube in such a manner as to form a closed glass ball as an electric discharge region substantially at the middle portion thereof and in which discharge electrodes are arranged confronted with each other, is supported at its two ends by metal supports welded to a short lead support and a long lead support which protrude from an insulating base in such a manner that the lead supports are parallel to each other with a predetermined distance therebetween and are parallel to the discharge axis of the lamp, in which, according to the invention, the metal support adapted to support the rear end portion of the discharge lamp has a discharge lamp holding portion which is arcuate, and the part of the rear end portion of the discharge lamp which is held by the discharge lamp holding portion of the metal support is circular in cross section.

Since the part of the rear end portion of the discharge lamp which is a part of the original glass pipe and circular in cross section is held with the arcuate discharge-lamp-holding portion of the metal support, in the invention, unlike the prior art in which the corresponding part is rectangular in cross section, stress is scarcely concentrated in that part. As a result, the durability of the lamp unit is significantly improved.

Moreover, since discharge lamp holding portion of the metal support is arcuate, the metal support can be manufactured more readily than a conventional metal support having a discharge lamp holding portion which is rectangular in section.

The discharge lamp holding portion of the metal support and the part of the discharge lamp which is held with it are both circular in section, and therefore they can turn relative to each other.

DESCRIPTION OF THE PREFERRED EMBODIMENTS

A discharge lamp unit of a first preferred embodiment of the invention will be described with reference to FIGS. 3 through 5.

Figure 3:
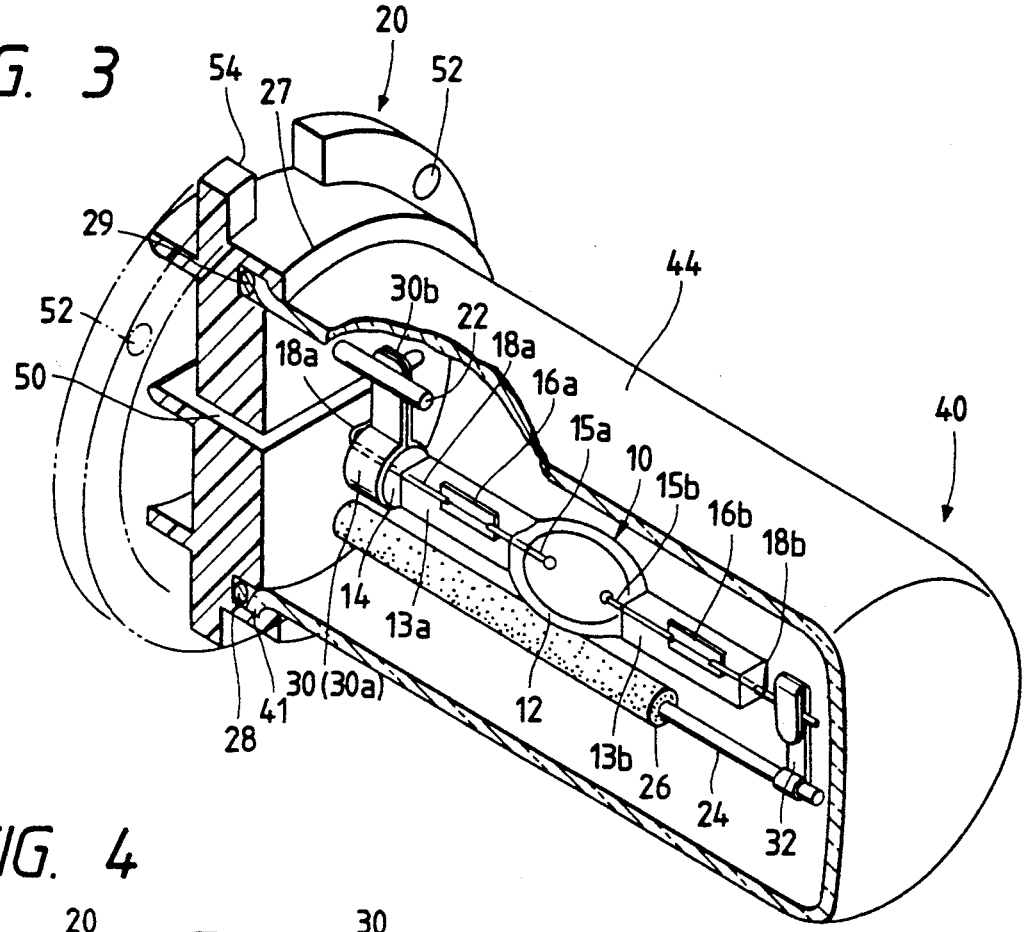
FIG. 3 is a perspective view, with parts cut away, showing a first embodiment of a discharge lamp unit constructed according to the invention.
Figure 4:
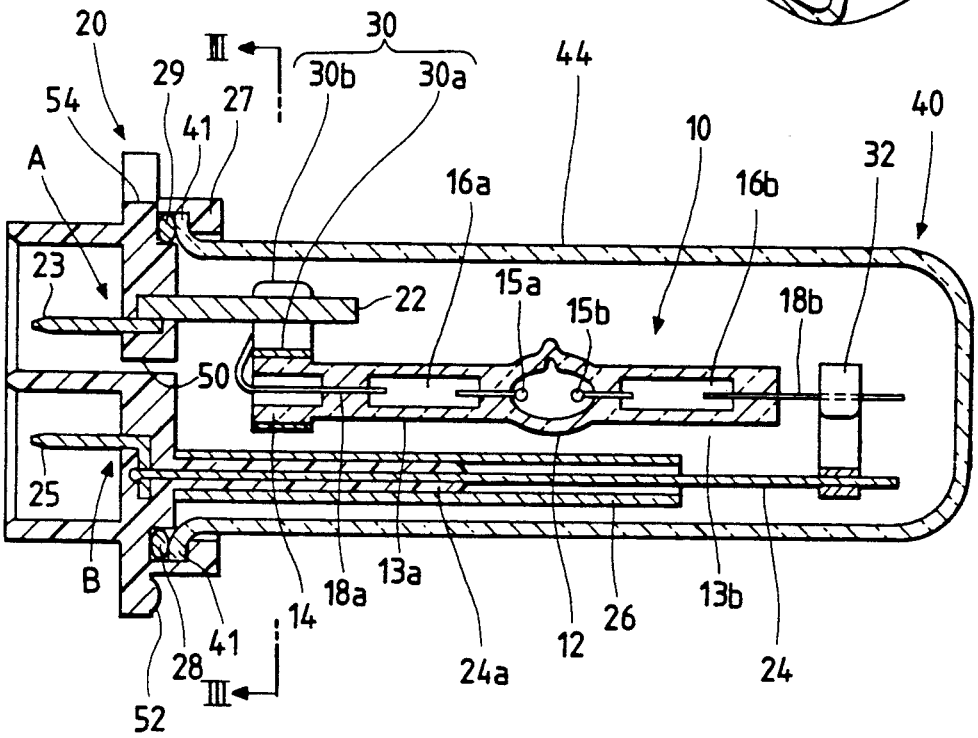
FIG. 4 is a longitudinal sectional view of the discharge lamp unit shown in FIG. 1.
Figure 5:
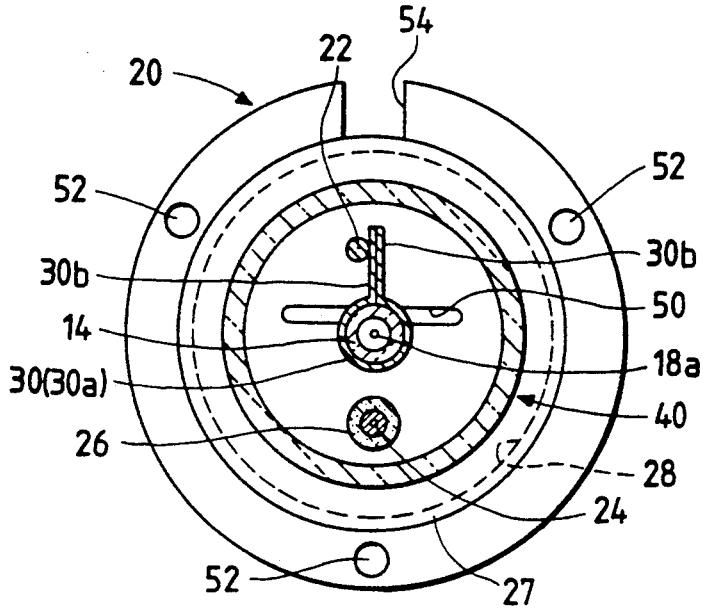
FIG. 5 is a cross sectional view taken along line III—III in FIG. 4.

FIG. 3 is a perspective view, with parts cut away, showing the discharge lamp unit according to the invention, FIG. 4 is a longitudinal sectional view of the discharge lamp unit, and FIG. 5 is a cross sectional view taken along line V—V in FIG. 3.

The discharge lamp unit of the first embodiment of the invention, as shown in FIGS. 3 through 5, includes a light emitting section, namely, a discharge lamp 10, lead supports 22 and 24 protruding from an insulating base 20 to support the discharge lamp 10, and an ultraviolet ray shielding globe 40 enclosing the discharge lamp 10.

The discharge lamp 10 is constructed as follows: A cylindrical-pipe-shaped quartz glass tube is pinched near both ends in such a manner as to form a closed glass ball 12 with pinch-sealed portions 13*a* and 13*b* at opposite ends thereof, thus defining an electric discharge space. The pinch-sealed portions 13*a* and 13*b* are each rectangular in longitudinal section, and the closed glass ball 12 is elliptical in longitudinal section. A starting rare gas, mercury and metal halogenide are sealed in the glass ball 12. The pinch-sealed portion 13*a* is integral with an elongation 14 in the form of a cylindrical sleeve or pipe, which is not pinch-sealed. That is, the cylindrical elongation 14 is not pinch-sealed while heat forming the glass ball 12 from the original cylindrical sleeve or pipe, so that no residual stress or no heat deformation is occurred in the cylindrical elongation 14. The elongation 14 is held with a metal support 30 (described later). Discharge electrodes 15*a* and 15*b* made of tungsten are disposed in the electric discharge space in such a manner that they confront each other. The discharge electrodes 15*a* and 15*b* are connected to molybdenum foils 16*a* and 16*b* sealed in the pinch-sealed portions 13*a* and 13*b*, respectively. The other ends of the molybdenum foils 16*a* and 16*b* are connected to lead wires 18*a* and 18*b*, respectively, which protrude from the ends of the pinch-sealed portions 13*a* and 13*b*, respectively. The lead support 22 is shorter than the lead support 24. The lead supports 22 and 24 are embedded in the insulating base 20 in such a manner that they extend forwardly of the base 20. The lead supports 22 and 24 thus support the discharge lamp 10 at both ends through metal supports 30 and 32.

The insulating base 20 is made of a synthetic resin such as PPS. A flat-plate-shaped connector terminal 23 is connected to the lead support 22 by spot-welding in such a manner that it extends from the rear surface of the insulating base 20, while an L-shaped connector terminal 25 is connected to the lead support 24 by plasma welding in such a manner that it extends from the rear surface of the base 20.

The metal support 30 is formed as follows: The middle portion of a belt- or band-shaped metal plate having a predetermined width is bent into an arcuate lamp holding portion 30*a*. The remaining portions, namely, both end portions of the metal plate, are left as they are, being employed as plate-shaped flange portions 30*b* and 30*b*. With the plate-shaped flange portions 30*b* and 30*b* abutted against each other, the elongation 14 of the discharge lamp is held by the lamp holding portion 30*a*. Under this condition, the flange portions 30*b* and 30*b* are connected to the end portion of the lead support 30 by spot-welding. Accordingly, the discharge lamp 10 can be slid with respect to the lamp holding portion 30*a* in an axial direction (to the right or to the left in FIG. 3), or it can be turned around its axis; that is, the discharge region of the discharge lamp 10 can be suitably positioned with respect to the reflector (not shown).

The rear lead wire 18*a* extending from the elongation 14 of the discharge lamp is spot-welded to the metal support 30. The metal support 32 supporting the front end portion of the discharge lamp 10 is also formed by bending a belt-shaped metal plate having a predetermined width. For this purpose, one end portion of the belt-shaped metal plate is clamped on the end portion of the lead support 24 and spot-welded thereto, while the other end portion is folded to hold the front lead wire 18*b*, and spot-welded thereto.

In FIGS. 3 through 5, reference numeral 26 designates a discharge-preventing ceramic insulating cylinder placed on the base portion 24*a* of the lead support 24.

The insulating base 20 has a frame 27 which is L-shaped in section on the front surface. The frame 27 has a globe mounting annular groove 28 with which the outer flange 41 of the ultraviolet ray shielding globe 40 (described later in detail) is engaged. An 0-ring 29 is fitted in the globe mounting groove 28 so as to elastically hold the outer flange 41 of the globe 40. The frame 27 is joined to the base 20 as follows: First, the outer flange 41 of the globe 40 is placed on the 0-ring 29. Then, with the 0-ring 29 compressed, an annular member L-shaped in section for forming the frame 27 is connected to the front surface of the base 20 by ultrasonic welding.

Reference numeral 40 designates the aforementioned ultraviolet ray shielding globe, which is closed at the front end in the manner of a cup. The globe 40 is fixedly mounted on the insulating base, enclosing the lead supports 22 and 24 and the discharge lamp 10. The aforementioned outer flange 41 extends from the edge of the opening of the globe 40 so as to engage the globe mounting groove 28. The globe 40 is made of glass, and the outer wall of the globe 40 is coated with an ultraviolet ray shielding film 44 made of ZnO. Therefore, with the globe 40 mounted fixedly on the base 20, the ultraviolet ray shielding film 44 covers the discharge lamp 10 so that it absorbs the ultraviolet rays which the discharge lamp 10 produces when emitting light, as a result of which only visible light from which ultraviolet rays have been removed is allowed to emerge from the globe 40. In order to reduce to zero the transmittance of ultraviolet rays shorter than 370 nm in wavelength, the ultraviolet ray shielding film should be at least 1.6 μm in thickness. In order to prevent the film from coming off the globe, it is preferable that the thickness be 5 μm or less. The wavelength range of ultraviolet rays which can be cut off depends on the ambient temperature of the globe (the wavelength range being shifted towards the long wavelength range as the temperature increases). Hence, the film thickness is set to a value at which ultraviolet rays 370 to 380 nm or less in wavelength can be cut off.

The ultraviolet ray shielding film can be formed by dipping, vacuum deposition, spraying, and other coating methods. In the case where the dipping method is employed, the thickness of the ultraviolet ray shielding film can be adjusted by changing the speed of extracting the globe out of the coating solution, or by changing the number of times of dipping the globe in the coating solution. In the case where the vacuum deposition method is employed, the film thickness can be adjusted by changing the frequency of vacuum deposition. In the case where the spraying method is employed, the film thickness can be adjusted by changing the coating solution spraying frequency.

In FIGS. 3 through 5, reference numeral 50 designates a ventilating hole 50 formed in the insulating base 20. The hole 50 communicates the space around the discharge lamp in the globe 40 with the outside to accelerate the convection of air in the globe 40 and the flow of air into and from the globe 40, thereby to improve the heat radiation of the globe. The formation of the ventilating hole 50 in the insulating base 20 increases the material density of the portions of the insulating base close to the ventilating hole 50 so that the dielectric strength of the insulating base 20 is increased between conductor assembly A of the terminal 23 and the lead support 22 and the conductor assembly B of the terminal 25 and the lead support 24, thus preventing electrical discharge between the two conductor assemblies A and B.

Figure 1:
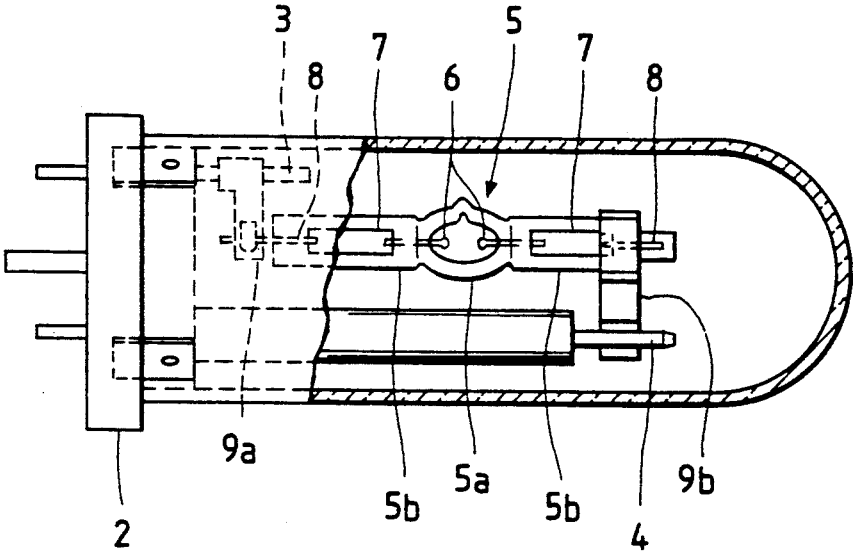
FIG. 1 PRIOR ART
FIG. 1 is a side view, with parts cut away, showing a conventional discharge lamp unit.
Figure 2:
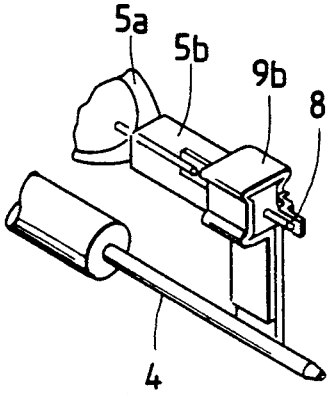
FIG. 2 PRIOR ART
FIG. 2 is a perspective view of essential components of the conventional discharge lamp unit shown in FIG. 4.

In FIGS. 1 through 3, reference numeral 52 designates protrusions formed on the front surface of the peripheral portion of the insulating base 20 used to position the bulb (the discharge lamp unit) in the axial direction. More specifically, the protrusions 44 are abutted against the wall in which the bulb mounting hole (not shown) is formed, thereby to determine the position of the bulb in the direction of axis.

Further in FIGS. 1 through 3, reference numeral 54 designates a circumferential positioning slot formed in the peripheral portion of the insulating base 20. When the bulb (discharge lamp unit) is engaged with the bulb mounting hole (not shown), the slot 54 is engaged with a protrusion formed on the side of the bulb mounting hole to fixedly determine the position of the bulb in the circumferential direction.

As described above, in the discharge lamp unit according to the invention, the elongation of the discharge lamp which is held by the metal support is free from residual stress since it is not pinch-sealed and is in the form of a pipe circular in section, which contains little stress compared with an elongation of rectangular section. Accordingly, the holding of the elongation with the metal support applies less stress to the elongation, and accordingly damage to the elongation is prevented; that is, the discharge lamp is improved in durability.

The lamp holding portion of the metal support is formed so as to coincide in configuration with the outer cylindrical wall of the elongation of the discharge lamp. Hence, the lamp holding portion can be formed with ease compared with a lamp holding portion of rectangular section. Thus, the metal support, and accordingly the discharge lamp unit, can be manufactured with ease.

Since the lamp holding portion of the metal support and the elongation of the discharge lamp are circular in section, the position of the discharge lamp can be readily adjusted with respect to the reflector.

A discharge lamp unit constructed in accordance with a second embodiment of the invention will be described with reference to FIGS. 6 through 10.

Figure 6:
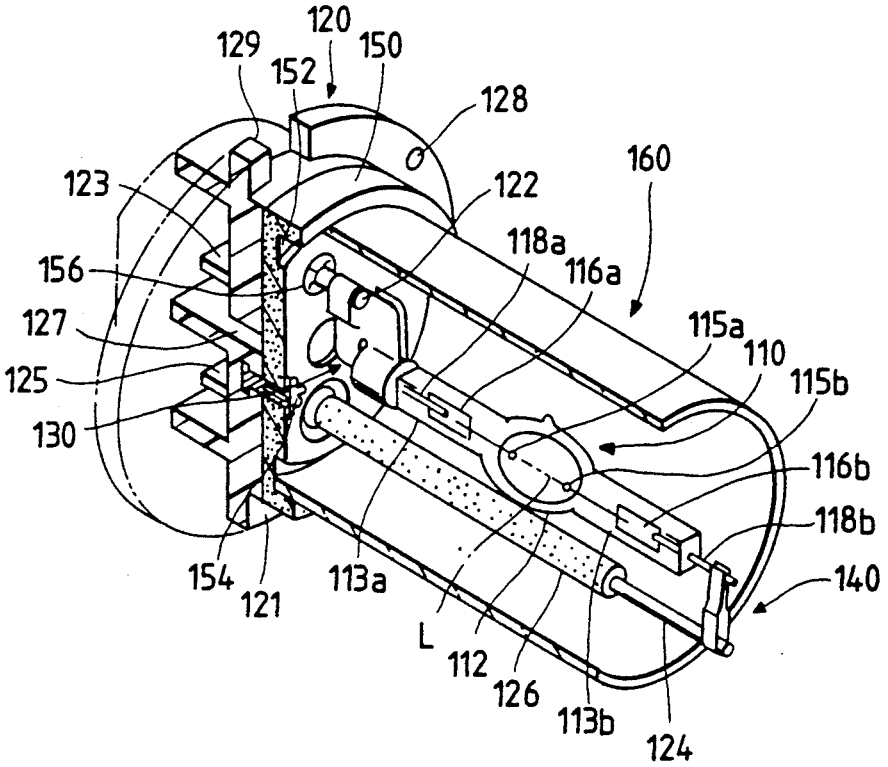
FIG. 6 is a perspective view showing a discharge lamp unit constructed in accordance with a second embodiment of the invention.
Figure 7:
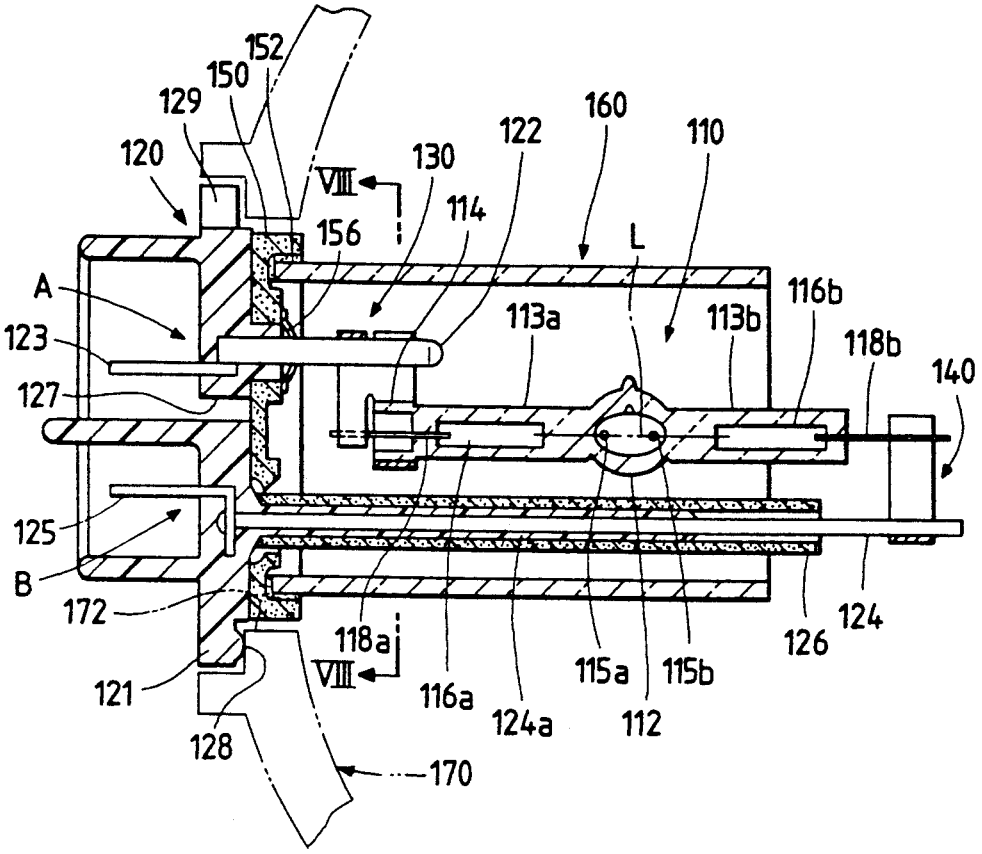
FIG. 7 is a longitudinal sectional view taken along line VII—VII in FIG. 8, showing the discharge lamp unit of FIG. 6.
Figure 8:
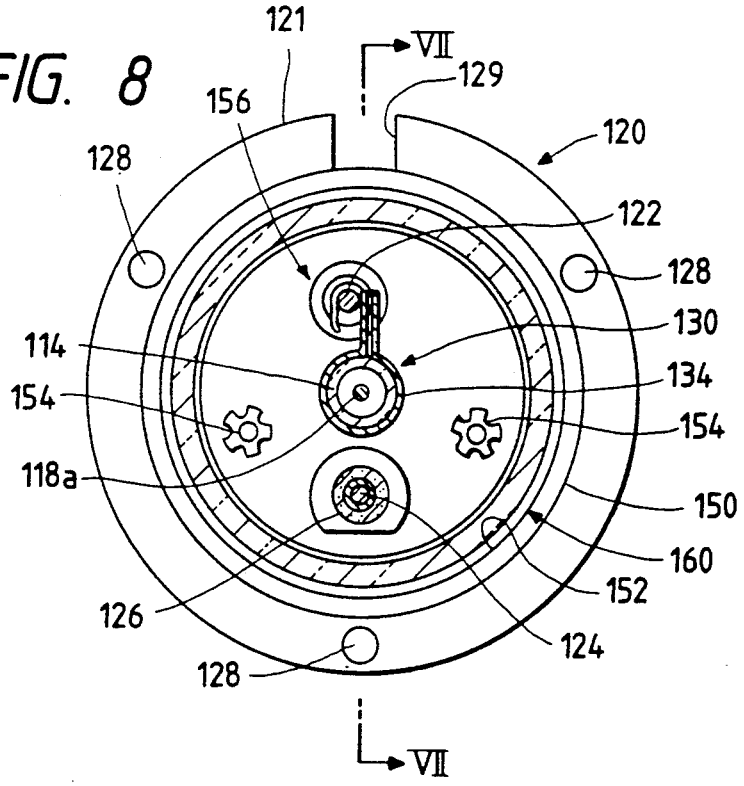
FIG. 8 is a cross sectional view taken along line VIII—VIII in FIG. 7.
Figure 9:
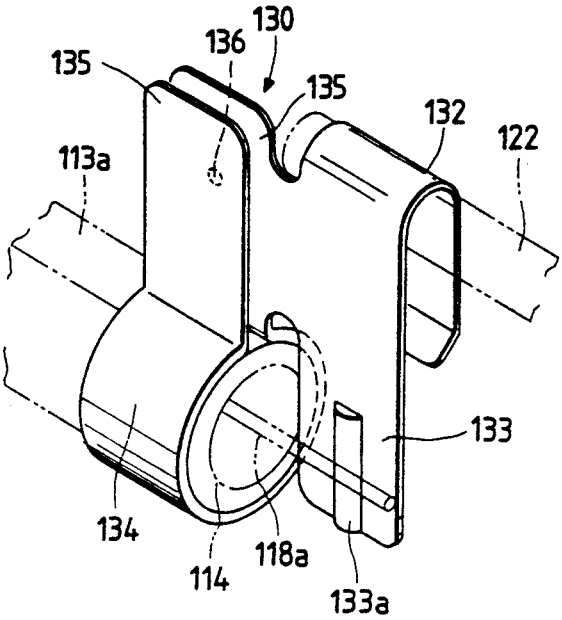
FIG. 9 is a perspective view of a metal support adapted to support the rear end portion of a discharge lamp.
Figure 10:
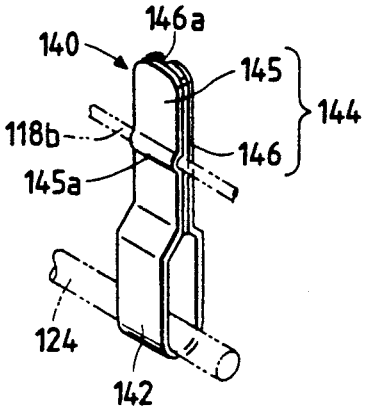
FIG. 10 is a perspective view of a metal support adapted to support the front end portion of the discharge lamp.

FIG. 6 is a perspective view, with parts cut away, showing the discharge lamp unit according to the invention. FIG. 7 is a longitudinal sectional view of the discharge lamp unit. FIG. 8 is a cross sectional view taken along line VIII—VIII in FIG. 7. FIG. 9 is an enlarged perspective view of a metal support adapted to support the rear end portion of the discharge lamp. FIG. 10 is a perspective view of a metal support adapted to support the front end portion of the discharge lamp.

The discharge lamp unit of this embodiment of the invention, as shown in these figures, includes a light emitting section, namely, a discharge lamp 110, lead supports 122 and 124 protruding from an insulating base 120, the lead supports serving as current conductors and supporting the discharge lamp 110, metal supports 130 and 140 secured to the lead supports 122 and 124, respectively, to directly support the discharge lamp 110, and an ultraviolet ray shielding globe 160 enclosing the discharge lamp 110 and the discharge lamp supporting members 122, 124, 130 and 140.

The discharge lamp 110 is constructed as follows: A cylindrical-pipe-shaped quartz glass tube is pinched near both ends thereof in such a manner as to form a closed glass ball 112 with pinch-sealed portions **113*a* and 113*b* at both ends. The closed glass ball 112 defines an electric discharge space. The pinch-sealed portions 113*a* and 113*b* are each rectangular in longitudinal section, and the closed glass ball 112 is elliptic in longitudinal section. A starting rare gas, mercury and metal halogenide are sealed in the glass ball 112. The pinch-sealed portion 113*a* has an elongation 114 which is in the form of a cylindrical sleeve or pipe which is not pinch-sealed. The elongation 114 is held with a metal support 130. Discharge electrodes 115*a* and 115*b* made of tungsten are disposed in the electric discharge space in such a manner that they are confronted with each other. The discharge electrodes 115*a* and 115*b* are connected to molybdenum foils 116*a* and 116*b* which are sealed in the pinch-sealed portions 113*a* and 113*b*, respectively. The other ends of the molybdenum foils 116a and 116b are connected to lead wires 118a and 118b, respectively, which protrude from the ends of the pinch-sealed portions 113a and 113b, respectively. A short lead support 122 and a long lead support 124 are embedded in the insulating base 120 in such a manner that they extend forwardly of the base 120. The lead supports 122 and 124 support the discharge lamp 110 at both ends through the metal supports 130 and 140**.

The lead supports 122 and 124 are laid spaced a predetermined distance from each other; that is, they are in parallel with each other, and the discharge axis L (passing through the electrodes 115a and 115b) of the discharge lamp 110 is thus parallel to the lead supports 122 and 124. The insulating base 120 is made of a synthetic resin such as PPS. A flat-plate-shaped connector terminal 123 is connected to the lead support 122 by spot-welding in such a manner that it extends from the rear surface of the insulating base 120, while an L-shaped connector terminal 125 is connected to the lead support 124 by plasma welding in such a manner that it extends from the rear surface of the base 120.

In FIGS. 6 and 7, reference numeral 127 designates an elongated through-hole formed in the central portion of the insulating base 120 in such a manner that it isolates the terminals 123 and 125 from each other. The formation of the elongated through-hole 127 results in an increase in material density of the central portion of the insulating base 120 near the through-hole 127. That is, the dielectric strength of the insulating base 120 is increased between the conductor assembly of the terminal 123 and the lead support 122 and the conductor assembly of the terminal 125 and the lead support 124, thus preventing the occurrence of electric discharge therebetween. Further in FIGS. 6 and 7, reference numeral 126 designates a discharge-preventing insulating cylinder which covers the base portion 124a of the lead support 124.

The metal support 130 supporting the rear end portion of the discharge lamp 110 is shown in FIG. 9 in detail. The metal support 130 is formed by bending a thin metal plate having a predetermined configuration in such a manner that it has a lead support clamping portion 132 which is substantially J-shaped and a lamp holding portion 134 which is substantially arcuate. The lead support clamping portion 132 is spot-welded to the end portion of the lead support 122. In FIG. 9, reference numeral 135 designates a pair of plate-shaped elongations which extend from both ends of the lamp holding portion 134. A protrusion 136 is formed on one of the surfaces of the plate-shaped elongations 135 and 135. The plate-shaped elongations 135 are spot-welded together at the protrusion 136 to cause the lamp holding portion 134 to hold the discharge lamp 110. As described above, the lead support clamping portion 132 is J-shaped; that is, it has two substantially parallel portions, one of which, namely, a plate-shaped downward elongation 133, extends to confront the lamp holding portion 134). The plate-shaped downward elongation 133 has a convex stripe 133a extending vertically, to which the rear lead wire 118a protruding from the elongation 114 of the discharge lamp 110 is spot-welded.

As described above, the elongation 114 of the discharge lamp 110 is held with the lamp holding portion 134 of the metal support 130. Therefore, not only can the discharge lamp be slid with respect to the lamp holding portion 134 in its axial direction (to the right and to the left in FIG. 6), but also it can be readily turned about its axis.

The discharge lamp unit is inserted into a bulb mounting hole 172 formed in a reflector (170 in FIG. 7) when in use. In this operation, the discharge lamp unit is positioned with respect to the reflector 170 with an insulating base periphery 121, which defines a focusing ring, as a reference. Since the discharge lamp 110 is slidable with respect to the lamp holding portion 134 of the metal support 130, the position of the discharge region (the closed glass ball) of the discharge lamp can be readily adjusted, and particularly its angular position can be adjusted with ease.

The other metal support 140 adapted to support the front end portion of the discharge lamp 110 is shown in FIG. 10 in detail. The metal support 140 is formed by bending a belt-shaped metal plate having a predetermined width in such a manner that it has a lead support clamping portion 142 and a lead wire clamping portion 144. The lead support clamping portion 142 is spot-welded to the end portion of the lead support 124. The lead wire clamping portion 144 is composed of pair of plates 145 and 146 which are confronted with each other. A horizontal concave stripe 145a and a vertical convex stripe 146a are formed on respective confronting surfaces of the plates 145 and 146. The lead wire 118b, held in the horizontal concave stripe 145a, is spot-welded to the lead wire clamping portion 144.

A ceramic disk 150 is integrally provided on the front surface of the insulating base 120. The ceramic disk 150 has an annular groove 151 in the front surface, with which an ultraviolet rays shielding globe 160 (described later) is fixedly engaged. The ceramic disk 150 is held abutted against the base 120 by peening the front ends of two rivets 154, which are embedded in the base 120 by insert-molding in such a manner that they protrude from the front surface of the base 120, and a push-on fixer 156 mounted on the lead support 122 is used to fixedly mount the ceramic disk 150 on the insulating base 120.

The ultraviolet ray shielding globe 160, which is in the form of a cylinder made of glass, is secured to the annular groove 152 of the disk 150 with an inorganic adhesive in such a manner as to surround the lead supports 122 and 124 and the discharge lamp 110. In order to ensure the adhesion of the globe 160 and the disk 150, it is desirable that the globe 160 and the disk 150 be substantially equal in thermal expansion coefficient. Therefore, the globe 160 is made of borosilicate glass (thermal expansion coefficient: $32.5\times10^{-7}/°$ C.), and the disk 150 is of mullite (thermal expansion coefficient: $36\times10^{-7}/°$ C.). The outer wall of the globe 160 is coated with an ultraviolet ray shielding film of ZnO or the like which is effective in cutting off ultraviolet rays 380 nm and lower in wavelength, which can present a health hazard. Therefore, when the output light of the discharge lamp 110 passes through the ultraviolet ray shielding globe, ultraviolet rays lower than 380 nm in wavelength are cut off; that is, only visible light from which the potentially dangerous ultraviolet rays been removed is allowed to emerge from the globe 160.

In FIGS. 6 through 8, reference numeral 128 designates protrusions formed on the front surface of the peripheral portion of the insulating base 120 used to position the bulb (i.e., the discharge lamp unit). More specifically, the protrusions 128 are abutted against the wall in which the bulb mounting hole 170 is formed, thereby to fix the position of the bulb in the axial direction.

Further in FIGS. 6 through 8, reference numeral 129 designates a circumferential positioning slot formed in the peripheral portion 121 (the focusing ring) of the insulating base 120. When the bulb (i.e.., the discharge lamp unit) is engaged with the bulb mounting hole 170, the slot 129 is engaged with a protrusion (not shown) formed on the side of the bulb mounting hole to fix the position of the bulb in the circumferential direction.

In the above-described embodiment, the pinch-sealed portion 113*a* has the elongation 114 which is in the form of a cylinder circular in section which is not pinch-sealed, and the elongation is held with the metal support 130. The elongation 114, being not pinch-sealed, is lower in residual stress than the pinch-sealed portion 113*a*. In addition, there is little concentration of stress in the elongation 114 because it is circular, as opposed to rectangular, in section. Thus, the elongation 114 supported by the metal support 130 is improved in durability.

Figure 11:
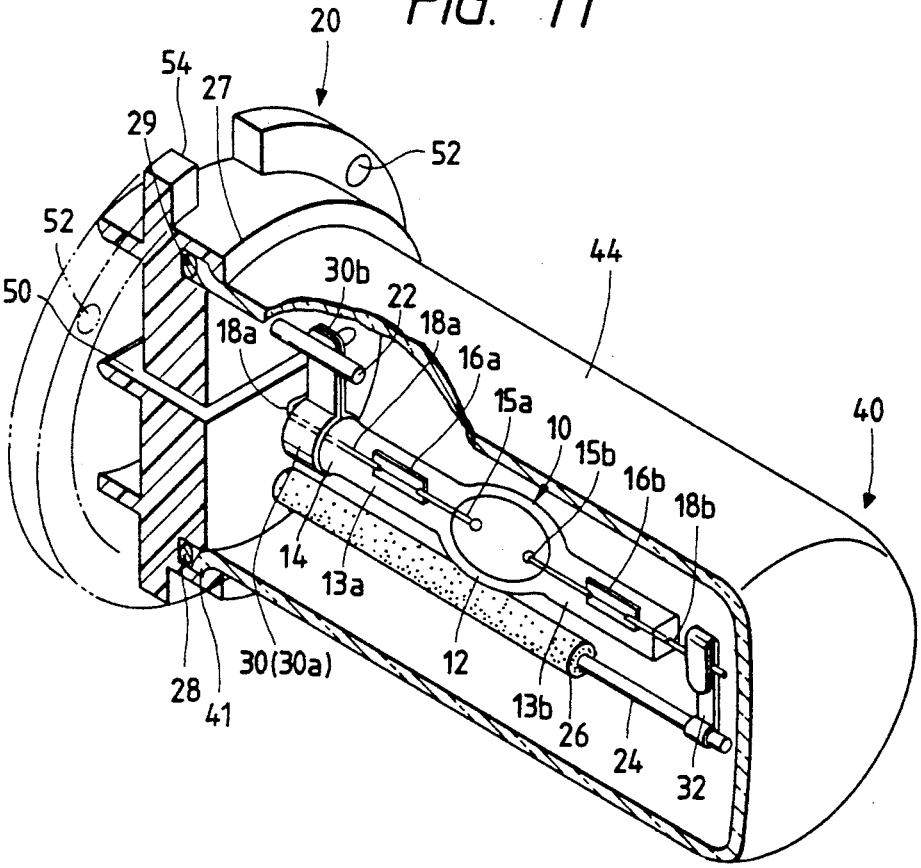
FIG. 11 is a perspective view, with parts cut away, showing an arrangement of a pinch-sealed portion of a discharge lamp unit constructed according to the invention.

On the other hand, the pinch-sealed portion 113*a* rectangular in section may have its pinch-sealed region as its elongation. In this case, the elongation is made circular in cross section so as to be held with the metal support 130. Furthermore, the pinch-sealed portion itself may be made cylindrically and circular in cross section as indicated as a cylindrical pinch-sealed portion 213*a* shown in FIG. 11 so that it is held directly by the metal support 130. In this case, the cylindrical elongation is partially disposed on or a part of the cylindrical pinch-sealed portion. In each of these cases, the part to be held by the metal support is circular in cross section, and it is thus inherently higher in durability than a pinch-sealed portion rectangular in section on which stress is liable to concentrate.

As described above, in the discharge lamp unit according to the invention, the concentration of stress in the part of the discharge lamp held by the metal support, because it is not rectangular but circular in cross section, is substantially eliminated. Hence, that part of the lamp unit is protected from damage; that is, the discharge lamp is significantly improved in durability.

The lamp holding portion of the metal support is arcuate. Hence, the lamp holding portion can be easily formed compared with a lamp holding portion which is rectangular in section. Thus, the metal support, and accordingly the discharge lamp unit, can be manufactured with ease.

Since the lamp holding portion of the metal support, and the part of the discharge lamp held by the latter, are both circular in section, the position of the discharge lamp can be readily adjusted with respect to the reflector.

What is claimed is:

1. A discharge lamp unit comprising:

a discharge lamp including:

a closed glass bulb and pinch-sealed portions extending from both ends of said closed glass bulb;

discharge electrodes arranged confronting one another in said closed glass bulb;

an elongated portion disposed at substantially an end of one of said pinch-sealed portions; and first and second lead wires protruding through respective ones of said pinch-sealed portions;

an insulating base;

first and second lead supports embedded in said insulating base and protruding from a face of said insulating base on a side of said discharge lamp; and first and second metal supports each for supporting said discharge lamp in said first and second lead supports, respectively, said first metal support being disposed near said insulating base, said first metal support comprising a band of metal having a cylindrical center portion for slidably and rotatably receiving said elongated portion of said discharge lamp and support said lamp on said first lead support via said elongated portion of said discharge lamp, and said second metal support connecting said second lead wire to said second lead support, said first metal support further comprises a unitary plate of predetermined configuration shaped and bent so as to form a substantially J-shaped lead support clamping portion and a substantially arcuate lamp holding portion, said lead support clamping portion being spot-welded to said first lead support, and said lamp holding portion conforming to and receiving said elongated portion, said lamp holding portion having a pair of plate-shaped elongations extending from both ends of said lamp holding portion.

2. The discharge lamp unit of claim 1, wherein said first metal support further comprises plate-shaped opposite end portions abutted against one another and spot-welded to said first lead support.

3. The discharge lamp unit of claim 1, wherein a protrusion is formed on a surface of one of said plate-shaped elongations, said plate-shaped elongations being spot-welded together at said protrusion.

4. The discharge lamp unit of claim 1, wherein said J-shaped lead support clamping portion has two substantially parallel portions, one of which extends to confront said lamp holding portion, said one of said parallel portions of said lead support clamping portion having a convex protrusion formed transverse to the lamp axis to which said first lead wire is spot-welded.

5. The discharge lamp unit of claim 1, wherein said second metal support comprises a belt-shaped metal plate bent to define a lead support clamping portion and a lead wire clamping portion, said lead wire clamping portion having a pair of plate portions confronting one another, said plate portions respectively having formed on confronting surfaces thereof a concave protrusion and a convex protrusion transverse to said concave protrusion, said second lead wire being held in said concave protrusion and being spot-welded to said second lead wire clamping portion.

6. The discharge lamp unit of claim 1, further comprising a ceramic base fixed to said insulating base.

7. The discharge lamp unit of claim 1, wherein said insulating base is formed of resin, said insulating base having an axial through-hole formed therein.

* * * * *